US008783046B2

(12) United States Patent
Doyle et al.

(10) Patent No.: US 8,783,046 B2
(45) Date of Patent: Jul. 22, 2014

(54) ICE DISPLAY DEVICE

(75) Inventors: James Doyle, Burbank, CA (US); Mark Fuller, Studio City, CA (US); Karl Nettmann, Glendale, CA (US)

(73) Assignee: WET Enterprises, Inc., Sun Valley, CA (US)

( * ) Notice: Subject to any disclaimer, the term of this patent is extended or adjusted under 35 U.S.C. 154(b) by 634 days.

(21) Appl. No.: 12/963,537

(22) Filed: Dec. 8, 2010

(65) Prior Publication Data

US 2011/0132004 A1 Jun. 9, 2011

Related U.S. Application Data

(60) Provisional application No. 61/267,765, filed on Dec. 8, 2009.

(51) Int. Cl.

| | |
|---|---|
| ***F25C 1/00*** | (2006.01) |
| ***F25C 1/18*** | (2006.01) |
| ***F25C 1/22*** | (2006.01) |
| ***A23G 9/00*** | (2006.01) |

(52) U.S. Cl.
USPC ..... 62/74; 62/345; 62/1; 62/354; 62/66; 62/340; 62/59; 62/344; 62/75

(58) Field of Classification Search
USPC ..... 62/74, 347, 354, 1, 66, 340, 59, 34, 62/345, 75, 312–313, 319, 333, 342, 435; 165/154, 141, 109.1
See application file for complete search history.

(56) References Cited

U.S. PATENT DOCUMENTS

| | | | | |
|---|---|---|---|---|
| 4,332,145 | A * | 6/1982 | Yuhasz et al. | 62/342 |
| 4,351,157 | A * | 9/1982 | Zeigler | 62/1 |
| 4,510,768 | A * | 4/1985 | Keller | 62/320 |
| 4,532,037 | A * | 7/1985 | Willinger | 210/167.26 |
| 4,576,016 | A * | 3/1986 | Nelson | 62/320 |
| 4,760,710 | A * | 8/1988 | Takagi | 62/354 |
| 4,898,002 | A * | 2/1990 | Taylor | 62/71 |
| 5,966,936 | A * | 10/1999 | Pruitt | 60/520 |
| 6,253,573 | B1 * | 7/2001 | Schwitters et al. | 62/513 |
| 6,381,968 | B1 * | 5/2002 | O'Donoghue et al. | 62/74 |
| 6,651,447 | B1 * | 11/2003 | Riedesel | 62/66 |
| 8,079,749 | B2 * | 12/2011 | Kitta | 366/149 |
| 8,132,424 | B2 * | 3/2012 | Burn | 62/345 |
| 8,176,973 | B2 * | 5/2012 | Liao | 165/104.26 |
| 8,272,231 | B2 * | 9/2012 | Dong | 62/342 |
| 2006/0054309 | A1 * | 3/2006 | Lee et al. | 165/109.1 |

* cited by examiner

*Primary Examiner* — Frantz Jules
*Assistant Examiner* — Martha Tadesse
(74) *Attorney, Agent, or Firm* — Maceiko IP

(57) ABSTRACT

An ice display device includes a chill tube and a piston that slides within the chill tube providing a fluidtight seal against the interior. The tube is filled with water and cooled to form an ice column. A shutter may selectively close the upper end of the chill tube with a fluidtight seal while the ice column is formed. The tube is warmed and the piston is lifted to an upper end of the tube to display the ice column. A plurality of water nozzles may selectively discharge streams of high pressure water inwardly to sculpt the ice column. An armature may extend upwardly from the piston to support and cool an interior of the ice column. The tube and armature may be cooled and warmed by a thermal transfer fluid. A device may be provided to induce turbulence in the thermal transfer fluid.

18 Claims, 7 Drawing Sheets

ICE DISPLAY DEVICE

CROSS REFERENCE TO RELATED APPLICATIONS

This application claims the benefit pursuant to 35 U.S.C. 119(e) of U.S. Provisional Application No. 61/267,765, filed Dec. 8, 2009, which application is specifically incorporated herein, in its entirety, by reference.

BACKGROUND

1. Field

Embodiments of the invention relate to the field of ice making; and more specifically, to sculptural ice displays.

2. Background

Water features such as ornamental fountains may be provided as dramatic focal points for sites such as hotels, amusement parks, and shopping centers. Such water features may provide a unique visual symbol that becomes associated with the site where they are located. It would be desirable to create a water feature that provides a striking and memorable appearance that is distinctly different from other water features for use as a unique visual symbol.

SUMMARY

An ice display device includes a chill tube and a piston that slides within the chill tube providing a fluidtight seal against the interior. The tube is filled with water and cooled to form an ice column. A shutter may selectively close the upper end of the chill tube with a fluidtight seal while the ice column is formed. The tube is warmed and the piston is lifted to an upper end of the tube to display the ice column in a pool of water. A plurality of water nozzles may selectively discharge streams of high pressure water inwardly to sculpt the ice column. An armature may extend upwardly from the piston to support and cool an interior of the ice column. The tube and armature may be cooled and warmed by a thermal transfer fluid. A device may be provided to induce turbulence in the thermal transfer fluid.

Other features and advantages of the present invention will be apparent from the accompanying drawings and from the detailed description that follows below.

BRIEF DESCRIPTION OF THE DRAWINGS

The invention may best be understood by referring to the following description and accompanying drawings that are used to illustrate embodiments of the invention by way of example and not limitation. In the drawings, in which like reference numerals indicate similar elements:

FIG. 6 is a schematic diagram of the arrangement of valves shown in

FIG. 5.

DETAILED DESCRIPTION

In the following description, numerous specific details are set forth. However, it is understood that embodiments of the invention may be practiced without these specific details. In other instances, well-known circuits, structures and techniques have not been shown in detail in order not to obscure the understanding of this description.

Figure 1:
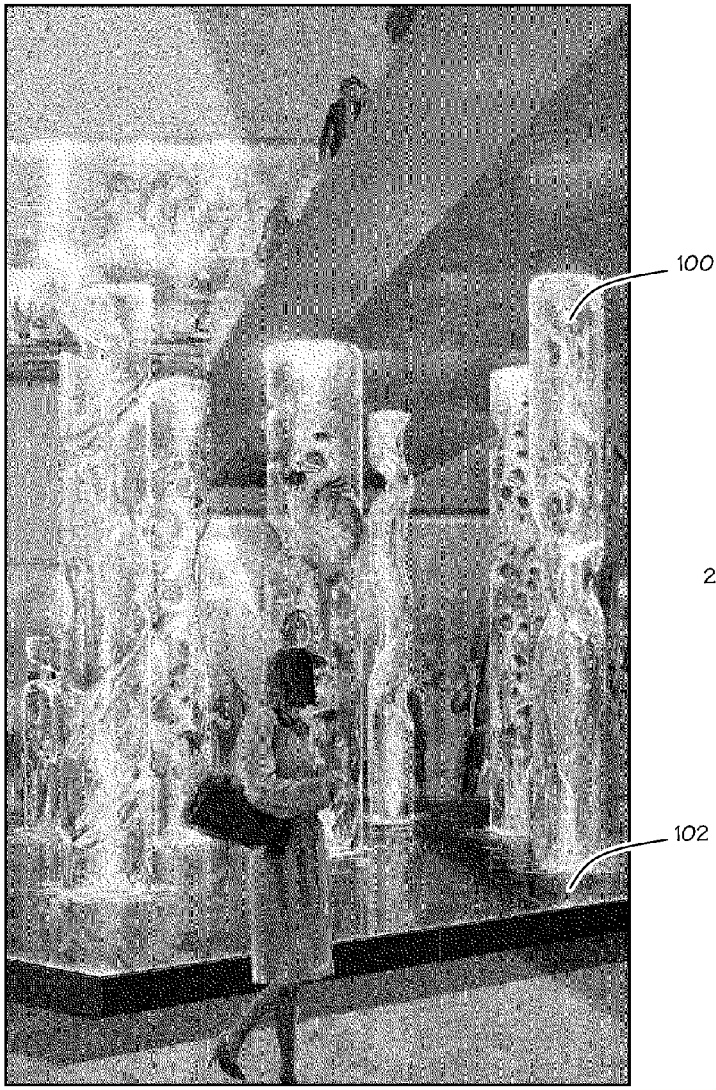
FIG. 1 is a pictorial view of a number of sculpted ice columns displayed above a pool of water as may be provided by the invention.

FIG. 1 shows a pictorial view of a number of sculpted ice columns 100 displayed above a pool of water 102 as may be provided by the invention. The ice columns may be substantial in size. For example, in a display of the type illustrated, the ice columns may be 12 to 24 inches in diameter and perhaps 15 to 18 feet tall. Of course, ice columns of significantly different sizes may also be produced according to the invention. Unsculpted ice columns may also be produced according to the invention.

Figure 2:
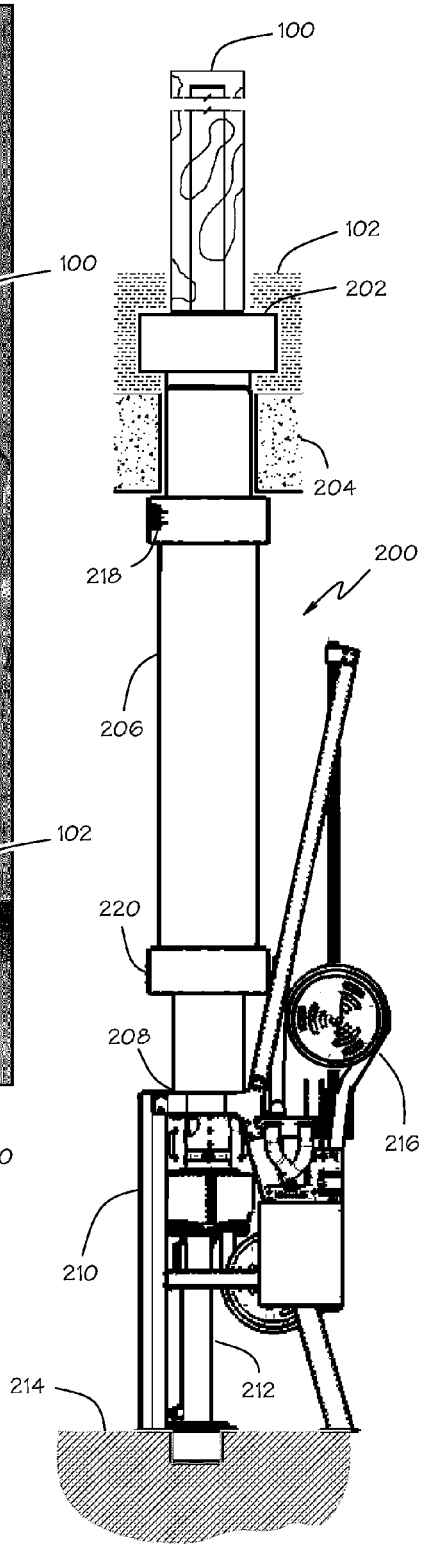
FIG. 2 is a side elevation of an ice display device with the ice column in the presentation or display position above the pool of water.

FIG. 2 is a side elevation of an ice display device 200 with the ice column 100 in the presentation or display position above the pool of water 102. The ice display device 200 may be located largely under a floor 204 with the upper end 202 of the device passing through an opening in the floor. The upper end 202 of the device may be in the pool of water 102 and somewhat below the surface of the water.

The ice display device 200 includes a chill tube 206 surrounded by a jacket that receives a first thermal transfer fluid to cool the tube sufficiently to freeze water contained within the tube. The chill tube 206 has an interior with a cross-section that extends uniformly from an open upper end to an opposing lower end 208. While the device 200 is illustrated with a tube having a circular cross-section, it is possible to use other cross-sections with the invention, such as square, triangular, star shaped, and the like. Thus, while a right circular cylinder is illustrated, the invention may use a cylindrical tube in the broadest mathematical sense of the term cylindrical.

The ice display device 200 is supported by a foundation 214, such as a substantial floor, which supports a frame 210 that holds the chill tube 206 and other parts of the device. A lift mechanism 212 is also supported by the foundation 214 to elevate the ice column 100 for display as will described in detail below. A dancer roller system 216 may be provided to support utilities that are connected to the moving parts of the device 200, allowing the connection to extend and retract as the ice column is raised and lowered.

Figure 3:
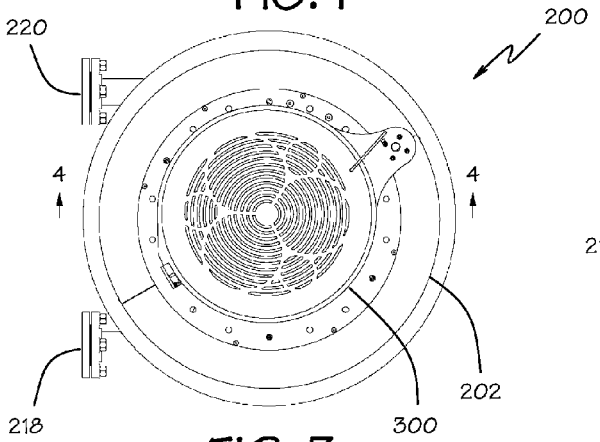
FIG. 3 is a top view of the device.

FIG. 3 shows a top view of the device 200. The ice column has been lowered and a shutter 300 closes the upper end 202 of the device 200. In embodiments that include a shutter, the shutter may provide a fluidtight closure of the upper end 202 of the device 200. Couplings may be provided for a supply 220 and a return 218 of thermal transfer fluid that can lower or raise the temperature of the chill tube 206.

Figure 4A:
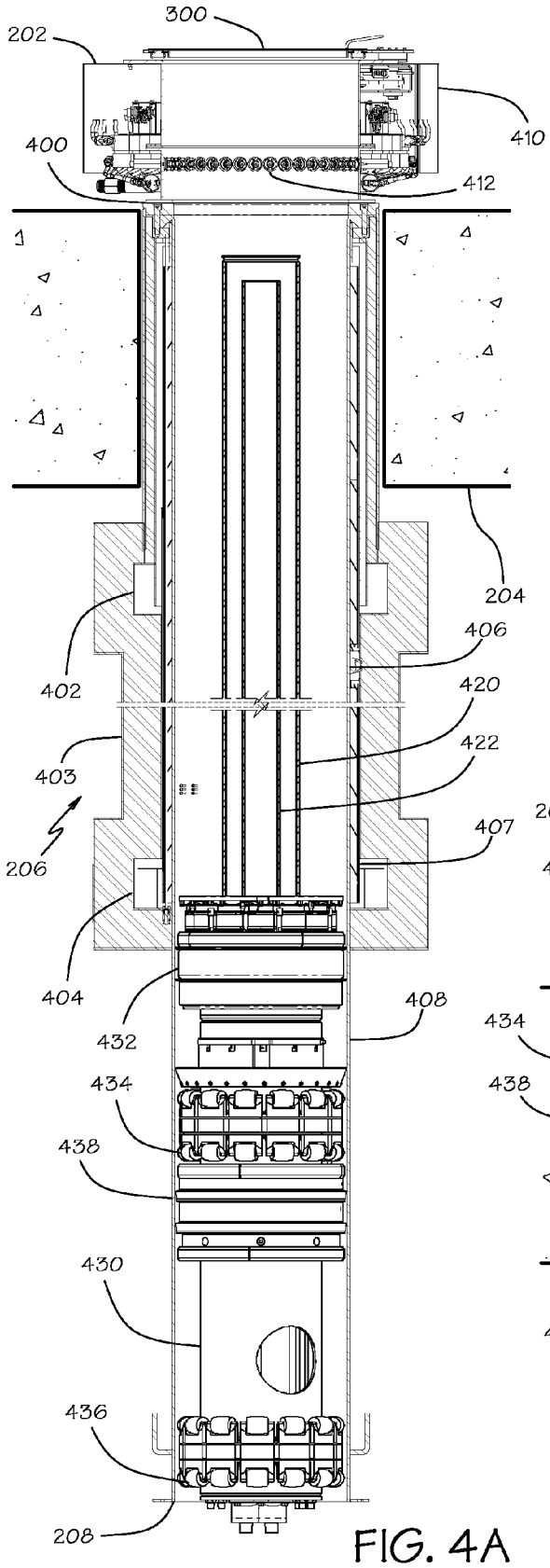
FIG. 4A is a cross-section of a portion of the device taken along section line 4-4 in FIG. 3.

FIG. 4A shows a cross-section of a portion of the device 200 taken along section line 4-4 in FIG. 3. A central portion of the chill tube 206, which is substantially similar to the adjacent portions, has been omitted as indicated by the dashed lines.

The chill tube 206 includes an inner tube 408 with central and upper portions surrounded by a jacket 403. The jacket provides an outer layer of insulation and an inner portion that receives a thermal transfer fluid, such as brine, ethylene glycol, propylene glycol, or other fluid with a freezing point substantially lower than water. The thermal transfer fluid may be received in a lower manifold 404 and discharged from an upper manifold 402. It will be appreciated that the upper portion of the chill tube may have little or no insulation and that the upper manifold 402 may be below the upper end 400 of the chill tube so that the chill tube can pass through a floor 204 without requiring an unduly large opening in the floor. It will be further appreciated that the floor may be the bottom of a water filled pond and that a watertight joint may need to be provided between the chill tube and the floor.

The chill tube 206 may include one or more strain gauges 406 that detect the hoop stress on the inner tube 408 of the chill tube 206. As water freezes it expands, which may increase the hoop stress on the inner tube 408. If the hoop stress detected by a strain gauge 406 increases to the point where there is a danger of the inner tube 408 rupturing, the supply of cold thermal transfer fluid is stopped. A warm thermal transfer fluid may be supplied to thaw ice within the chill tube 206.

The device 200 includes a piston 430 that slides within the chill tube 206 between the upper 202 and lower 208 ends. FIG. 4A shows the piston 430 at the lower extent of its travel.

The piston 430 provides a fluidtight seal against the interior using one or more seals 438, such as an O-ring or cup seal. The piston may include a number of rollers 434, 436 to support the piston within the chill tube 206 and to allow it to move freely. The piston may include an inflatable seal 432 the use of which is described below.

Figure 4B:
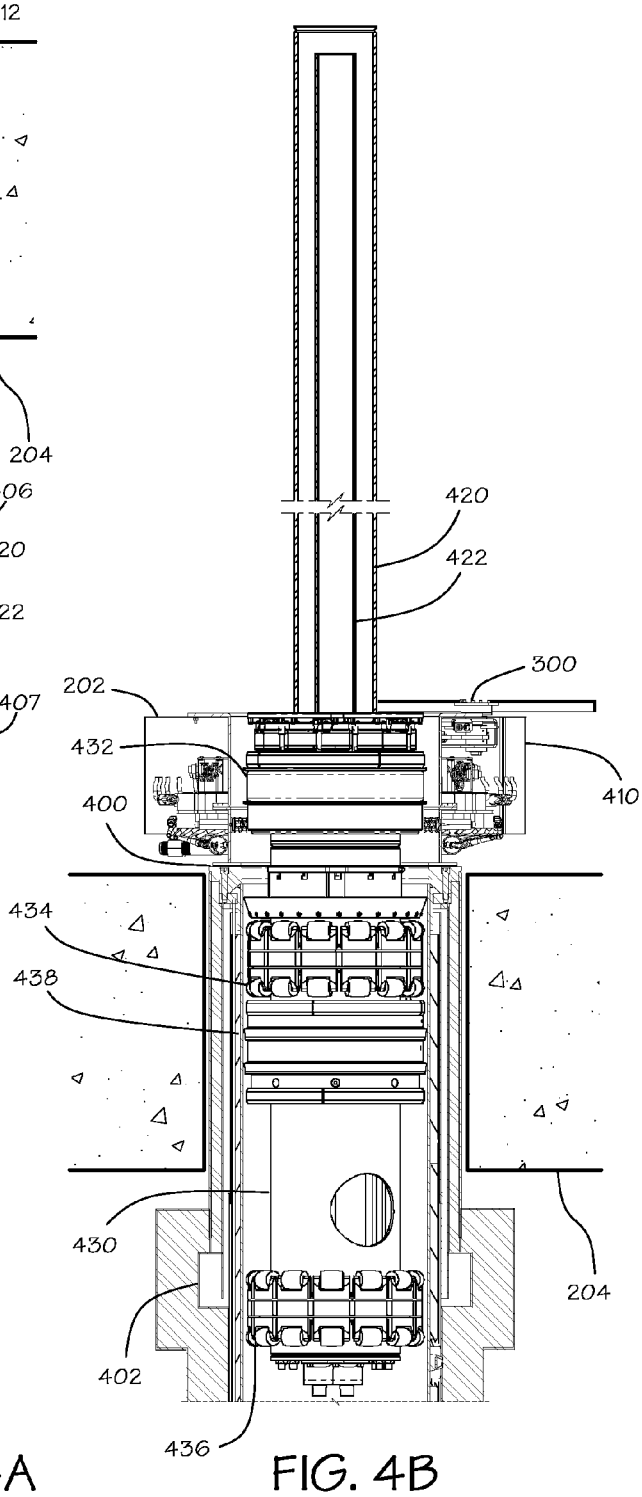
FIG. 4B is a cross-section of another portion of the device taken along section line 4-4 in FIG. 3 in another operative position.

FIG. 4B shows a cross-section of another portion of the device 200 taken along section line 4-4 in FIG. 3. Only the upper portion of the device is shown. In this view the piston 430 is shown at the upper extent of its travel.

Figure 4C:
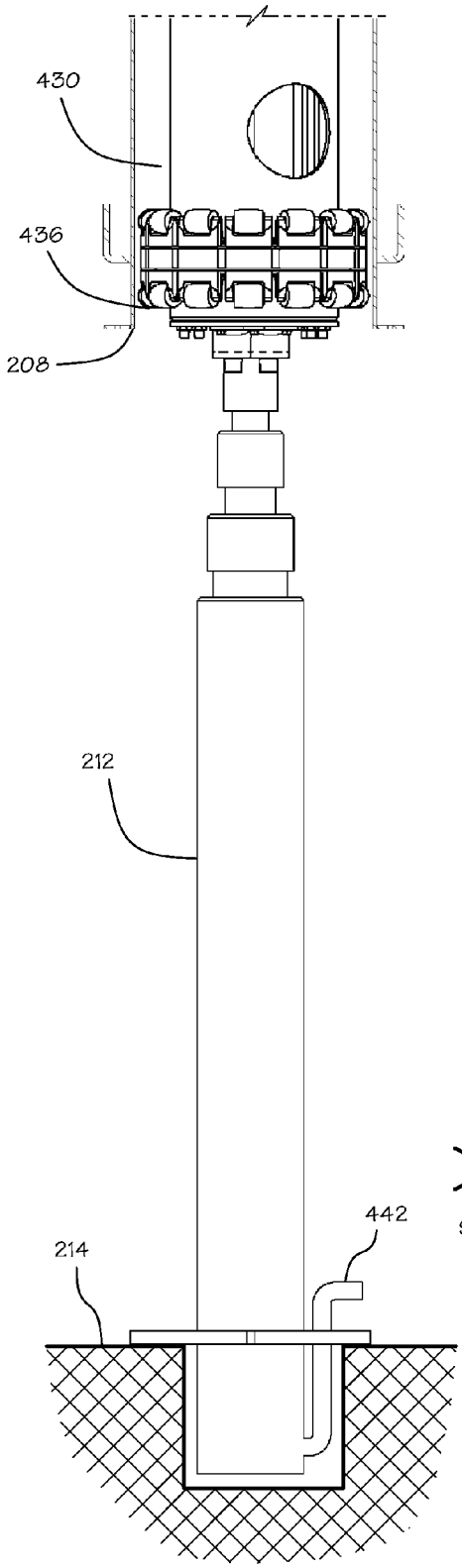
FIG. 4C shows a cross-section of yet another portion of the device taken along section line 4-4 in FIG. 3 with a lifting mechanism shown in elevation.

FIG. 4C shows a cross-section of yet another portion of the device 200 taken along section line 4-4 in FIG. 3. Only the lower portion of the device is shown. In this view the piston 430 is shown at the lower extent of its travel. A lifting mechanism 212, such as a telescoping hydraulic cylinder, couples the piston 430 to the supporting foundation 214. The lifting mechanism 212 is shown in elevation rather than cross-section for clarity. The lifting mechanism 212 can be extended to move the piston 430 between the upper 202 and lower 208 ends of the chill tube 206. For example, hydraulic fluid may be supplied to an inlet 442 on a hydraulic lifting mechanism to raise the piston. Allowing the hydraulic fluid to drain allows the piston to descend.

The device 200 may be used to create an ice display as follows. Assuming the upper end 202 of the device is located within a pond of water 102 somewhat below the surface, the piston 430 is lowered from the upper end 202 of the chill tube 206 to the lower end 208. This causes water to be drawn into the chill tube 206 from the pond. When the piston 430 is fully lowered, the lower portions of the piston may be drained to avoid the formation of ice that could interfere with movement of the piston. In particular, it is desirable to keep the rollers 434, 436 free of ice. In one embodiment, an inflatable seal 432 near the top of the piston 430 seals the piston when it is in the lowered position so that water below the inflatable seal can be drained.

A fluidtight shutter 300 on the upper end 202 of the chill tube 206 may be closed to isolate the water in the chill tube from the water in the pond above. A first thermal transfer fluid having a temperature below the freezing point of water, perhaps −20 to 31 degrees Fahrenheit, is supplied to the jacket on the chill tube 206 causing the water in the chill tube to freeze.

If the upper end of the chill tube 206 is closed by a shutter 300, water may need to be removed from the upper end of the interior of the chill tube to provide space for forming ice because water expands as it freezes. It may be desirable to bubble air through the water in the interior of the chill tube to promote formation of clear ice. If the upper end of the chill tube 206 is closed by a shutter 300, the air may need to be removed from the upper end of the interior.

When the water in the chill tube 206 has frozen to form an ice column, a second thermal transfer fluid having a temperature above the freezing point of water, perhaps 40 to 50 degrees Fahrenheit, is supplied to the jacket 403 on the chill tube. This thaws the ice adjacent the inner surface of the inner tube 408 to allow the ice column to be raised to the upper end 202 of the device 200 for presentation. The thawing may remove roughly ¼ of an inch of ice from the radius of the ice column.

The lifting mechanism 212 raises the piston 430 to elevate a least a portion of the ice column for display. If an inflatable seal 432 is used, it is deflated before moving the piston 430. If a shutter 300 is provided, it is opened before lifting the piston 430. The lifting mechanism may be capable of lifting a plain ice column into the presentation position fairly rapidly, perhaps at a rate of about 8 inches per second.

Referring to FIG. 4A, the ice display device 200 may further include a sculpting head 410 coupled to the upper end 400 of the chill tube 206. The sculpting head 410 includes a plurality of water nozzles 412 arranged to selectively discharge streams of high pressure water inwardly toward a long axis of the chill tube 206, the long axis being the central axis of the chill tube along which the piston 430 moves. The water nozzles 412 may be arranged such that there is roughly 1½ inches between nozzles, requiring about 30 nozzles for a tube that produces a 12 inch diameter ice column to about 50 nozzles for a 24 inch diameter ice column.

The nozzles may be supplied with water, perhaps drawn from the pond 102, that is pressurized, perhaps to between 300 and 500 pounds per square inch. The nozzles may have openings of about 1/32 of an inch through which the pressurized water is discharged. The nozzles may be configured to provide a flat fan spray with the flat of the spray being parallel to the floor. The fan may diverge with roughly a 5 degree angle to provide a substantially complete coverage of the circumference of the ice column.

The sculpting head 410 may be used to erode the ice column and produce an artistic sculptural display as the ice column is raised by the piston 430. The ice column may be raised at a slow rate, perhaps 3 inches per minute, to facilitate the sculpting process.

The ice display device 200 may further include an armature 420 rigidly coupled to the piston 430 such that the armature extends toward the upper end 400 of the cylindrical interior 408 when the piston is at the lower end 208 of the chill tube 206. The armature 420 includes inner passages that receive a second thermal transfer fluid, such as brine, ethylene glycol, propylene glycol, or other fluid with a freezing point substantially lower than water. The second thermal transfer fluid may be supplied at a temperature below the freezing point of water, perhaps −20 to 31 degrees Fahrenheit. The inner passages of the armature 420 may be arranged such that the cold thermal transfer fluid flows upwardly adjacent the surface of the armature and then returns downwardly through a central channel.

The armature 420 may hasten the freezing of the water. Further, the armature may continue to receive the chilled second thermal transfer fluid when the ice column is in the display position. This may delay melting of the displayed ice column. Further, the armature may provide mechanical support and reinforcement of the displayed ice column. The armature may be constructed of stainless steel with a polished outer surface to provide an attractive appearance when displayed with the ice column.

Figure 5:
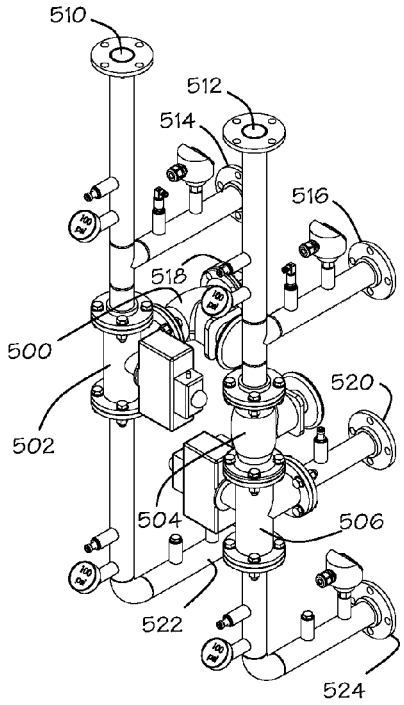
FIG. 5 is a pictorial view of an arrangement of valves for supplying first and second thermal transfer fluids.
Figure 6:
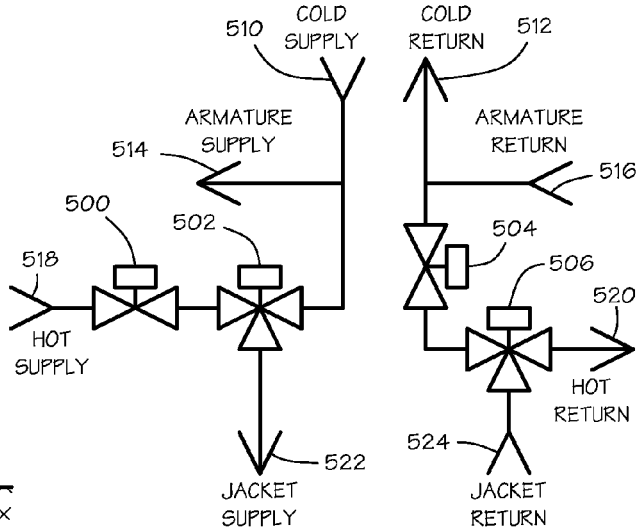

FIG. 5 is a pictorial view of an arrangement of valves for supplying the first and second thermal transfer fluids to the jacket 403 of the chill tube 206 and the armature 420. FIG. 6 is a schematic diagram of the arrangement of valves shown in FIG. 5. A cold thermal transfer fluid, one that is below 32 degrees Fahrenheit, is supplied at a cold supply port 510. A portion of the cold thermal transfer fluid is supplied to the armature 420 from an armature supply port 514. The cold thermal transfer fluid from the armature is returned to an armature return port 516 and thence to a cold return port 512. A chiller (not shown) receives the thermal transfer fluid from the cold return port 512, cools it, and supplies it to the cold supply port 510 in a recirculating system.

A hot thermal transfer fluid, one that is above 32 degrees Fahrenheit, is supplied at a hot supply port 518. A first three-way valve directs one of the cold or hot thermal transfer fluids to the jacket supply port 522 for delivery to the jacket 403 surrounding the chill tube 206. The thermal transfer fluid from the jacket is returned to the jacket return port 524. A second three-way valve directs the returned thermal transfer fluid to either the cold return port 512 or the hot return port 520 as appropriate.

The valve arrangement may further include a circuit balancing valve 500, 504 in each of the hot and cold circuits for the thermal transfer fluids that circulate through the jacket 403 surrounding the chill tube 206. The circuit balancing valve may be a two-way valve with an adjustable opening, such as a multi-turn globe valve, that allows the rate of flow within the circuit to be adjusted. The circuit balancing valve may be a pressure-compensating valve that maintains a set rate of flow regardless of pressure variations in the circuit.

The thermal transfer fluids may have substantial viscosity, particularly at lower temperatures. For example, ethylene glycol has a syrupy consistency at temperatures below 32 degrees Fahrenheit. Viscous fluids tend to adhere to the walls of channels through which they flow with only the central portions of the fluid moving with a substantial velocity. This reduces the rate of heat transfer between the fluid and the channel.

Figure 7:
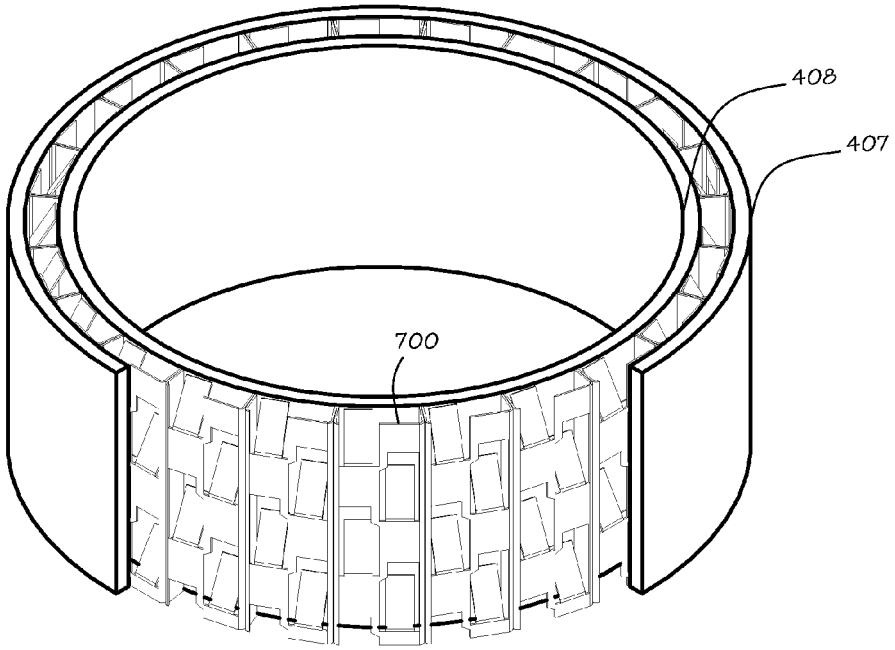
FIG. 7 is a pictorial view of turbulence inducing channels that may be used with the device.

FIG. 7 shows a pictorial view of a section of the inner tube 408 and second tube 407 that form the passage for the thermal transfer fluid in the jacket 403 surrounding the chill tube 206. A portion of the second tube 407 is cut away to show a number of turbulence inducing channels 700 in the jacket of the chill tube. The turbulence inducing channels 700 may create a turbulent flow of the thermal transfer fluid and thereby improve the rate of heat transfer between the fluid and the inner tube 408.

Figure 8:
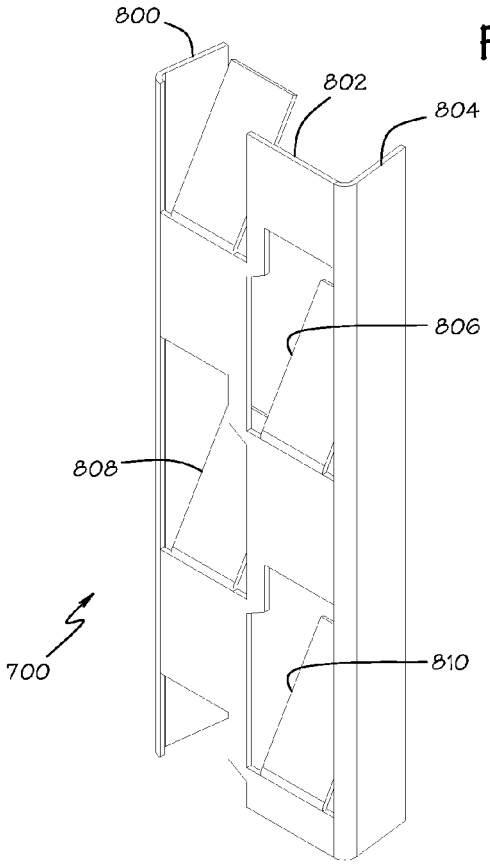
FIG. 8 is a pictorial view of a detail of a turbulence inducing channel shown in FIG. 7.
Figure 9:
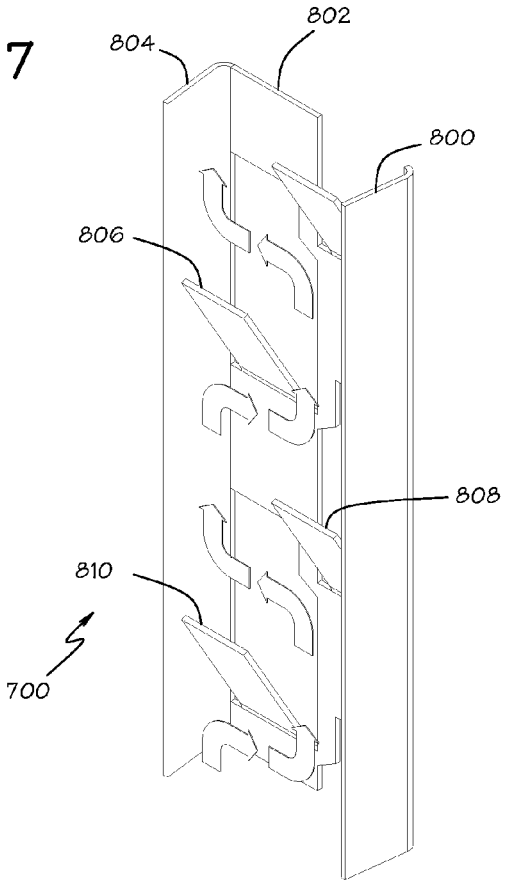
FIG. 9 is a pictorial view of the opposite side of the turbulence inducing channel shown in FIG. 8.

FIGS. 8 and 9 show pictorial views of two opposing sides of one of the turbulence inducing channels 700 shown in FIG. 7. Each turbulence inducing channel 700 includes a web 802 supported between two legs 800, 804 that extend from two opposing edges along a length of the web. The legs extend toward the interior of the chill tube when assembled. The web includes a plurality of deflectors 806, 808, 810 that extend from the web 802 at an angle toward the interior of the chill tube. Each deflector 806, 808, 810 has a width of approximately one-half a width of the web and is located adjacent one of the two legs 800, 804. A deflector 808 adjacent one 800 of the two legs is located in a staggered arrangement with deflectors 806, 810 adjacent the other 804 of the two legs. As suggested by the arrows, the turbulence inducing channel 700 causes the thermal transfer fluid to flow in a circuitous path which may create a turbulent flow that breaks up the stagnant layer that would otherwise form along the wall of the inner tube 408. The turbulence inducing channels 700 may be readily formed from sheet metal and arranged to fill the annular space between the inner tube 408 and second tube 407.

Figure 10:
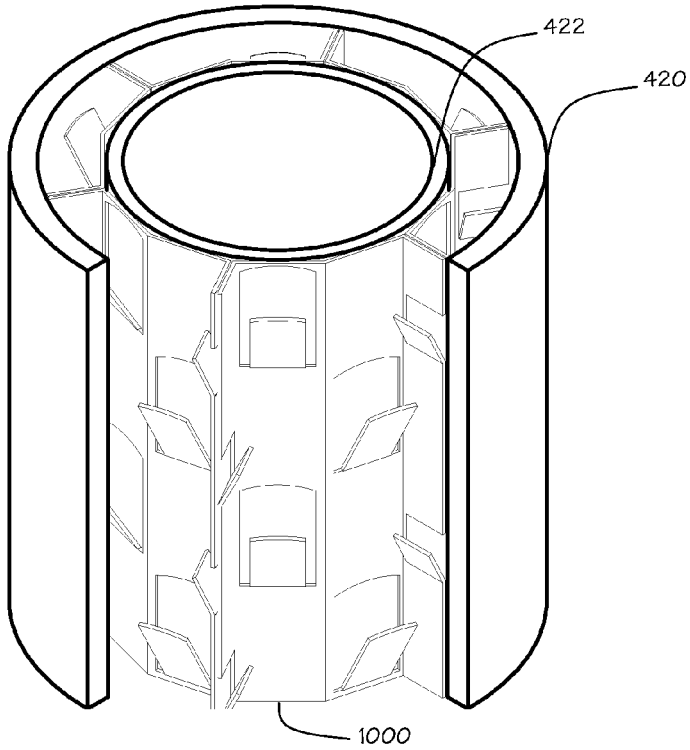
FIG. 10 is a pictorial view of other turbulence inducing channels that may be used with the device.

FIG. 10 shows a pictorial view of a section of the armature 420 and return tube 422. A portion of the armature 420 is cut away to show a number of turbulence inducing channels 1000 in the annular space between the armature and return tube. The turbulence inducing channels 1000 may create a turbulent flow of the thermal transfer fluid in a similar manner to those previously described for the chill tube 206.

Figure 11:
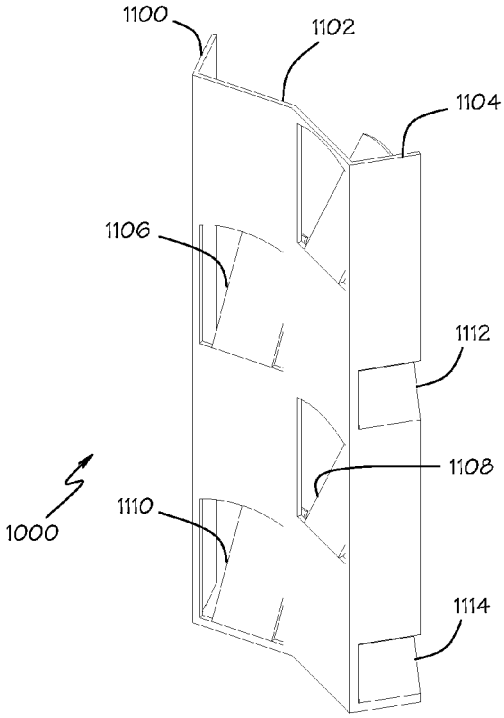
FIG. 11 is a pictorial view of a detail of a turbulence inducing channel shown in FIG. 10.
Figure 12:
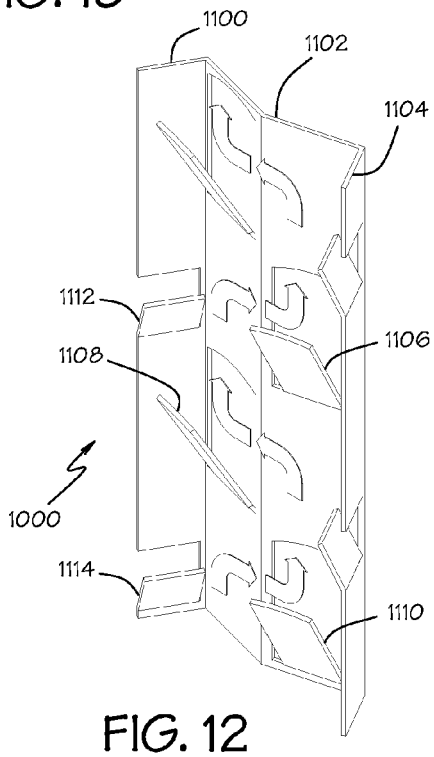
FIG. 12 is a pictorial view of the opposite side of the turbulence inducing channel shown in FIG. 11.

FIGS. 11 and 12 show pictorial views of two opposing sides of one of the turbulence inducing channels 1000 shown in FIG. 10. Each turbulence inducing channel 1000 includes a web 1102 supported between two legs 1100, 1104 that extend from two opposing edges along a length of the web. The legs extend toward the exterior of the armature 420 when assembled. The web includes a plurality of deflectors 1106, 1108, 1110 that extend from the web 1102 at an angle toward the exterior of the armature 420. Each deflector 1106, 1108, 1110 has a width of approximately one-half a width of the web and is located adjacent one of the two legs 1100, 1104. A deflector 1108 adjacent one 1104 of the two legs is located in a staggered arrangement with deflectors 1106, 1110 adjacent the other 1100 of the two legs. Additional deflectors 1112, 1114 may be formed in the legs 1104 between the adjacent deflectors 1108 in the web 1102.

As suggested by the arrows, the turbulence inducing channel 1000 causes the thermal transfer fluid to flow in a circuitous path which may create a turbulent flow that breaks up the stagnant layer that would otherwise form along the wall of the armature 420. The turbulence inducing channels 1000 may be readily formed from sheet metal and arranged to fill the annular space between the armature 420 and return tube 422. It will be noted that the web 1104 may be bent along the length of the channel as shown to more closely fit the annular space between the armature 420 and return tube 422, which has a significantly smaller radius than the annular space in the chill tube previously described.

Figure 13:
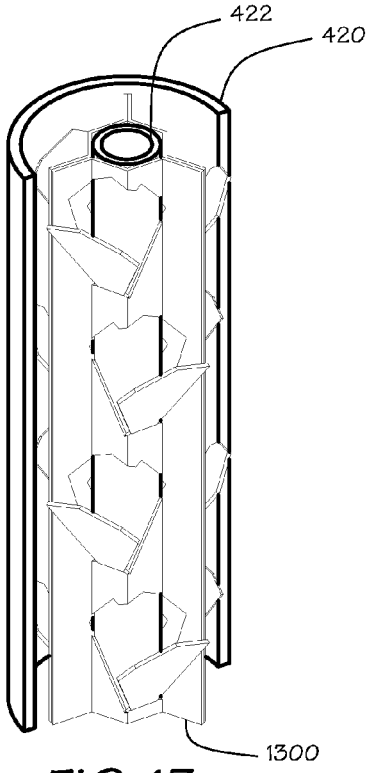
FIG. 13 is a pictorial view of still other turbulence inducing channels that may be used with the device.

FIG. 13 shows a pictorial view of another section of the armature 420 and return tube 422 for an embodiment where the armature and return tube have a significantly smaller radius than the embodiment illustrated in FIGS. 10-12. A portion of the armature 420 is cut away to show a number of turbulence inducing channels 1300 in the annular space between the armature and return tube. The turbulence inducing channels 1000 may create a turbulent flow of the thermal transfer fluid in a similar manner to those previously described.

Figure 14:
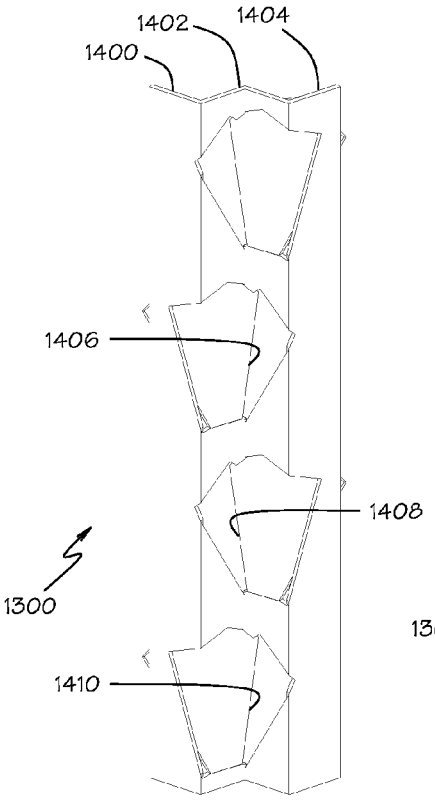
FIG. 14 is a pictorial view of a detail of a turbulence inducing channel shown in FIG. 13.
Figure 15:
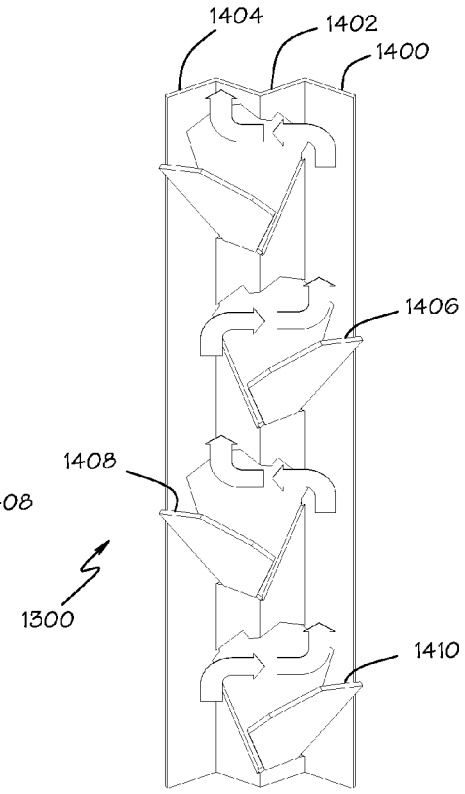
FIG. 15 is a pictorial view of the opposite side of the turbulence inducing channel shown in FIG. 14.

FIGS. 14 and 15 show pictorial views of two opposing sides of one of the turbulence inducing channels 1300 shown in FIG. 13. Each turbulence inducing channel 1300 includes a web 1402 supported between two legs 1400, 1404 that extend from two opposing edges along a length of the web similar to the turbulence inducing channels previously described. The web includes a plurality of deflectors 1406, 1408, 1410 that extend from the web 1402 at an angle toward the exterior of the armature 420. Each deflector 1406, 1408, 1410 has a width of approximately one-half a width of the web and is located adjacent one of the two legs 1100, 1104. A deflector 1408 adjacent one 1404 of the two legs is located in a staggered arrangement with deflectors 1406, 1410 adjacent the other 1400 of the two legs. The web 1404 in this embodiment may be bent along the length of the channel more sharply than in the embodiment shown in FIG. 10-12 to more closely fit the annular space between the armature 420 and return tube 422, which has a significantly smaller radius than the annular space in the armature previously described. It will be noted that each deflector 1406, 1408, 1410 has a fan shape to more closely fill about one-half the space between the legs 1400, 1404 in view of the bent web 1402 and the angle between the web and the legs.

Figure 16:
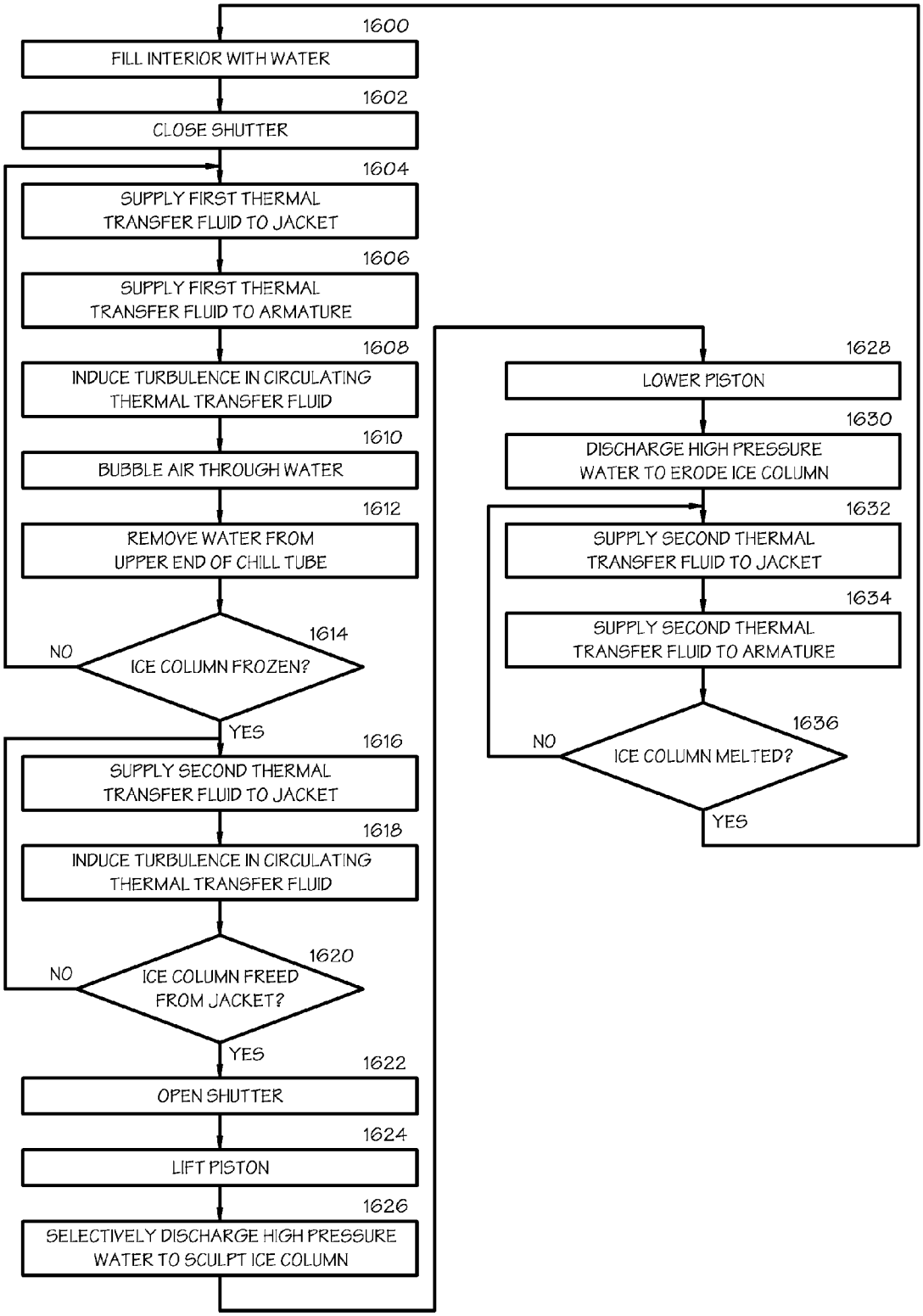
FIG. 16 is a flowchart for a method of creating an ice display according to an embodiment of the invention.

FIG. 16 is a flowchart for a method of creating an ice display according to an embodiment of the invention. It will be appreciated that other methods which perform some steps in different orders, perform some steps simultaneously, and/or omit some of the steps may also be used according to the invention. For the method described, it is assumed that the upper end 202 of the device 200 is located within a pond of water 102 somewhat below the surface.

A piston 430, which seals against a cylindrical interior 408 of the chill tube 206, is lowered to the lower end 208 of the chill tube. This causes the cylindrical interior to fill with water 1600. A shutter may be closed to provide a fluidtight seal of the upper end of the chill tube 1602.

A first thermal transfer fluid having a temperature below the freezing point of water is supplied to a jacket 407 on the chill tube 1604. Turbulence may be induced in the first thermal transfer fluid as it circulates through the jacket on the chill tube 1608. The first thermal transfer fluid may be supplied to an armature rigidly coupled to the piston and extending toward the upper end when the piston is at an opposing lower end of the cylindrical interior 1606. Turbulence may be induced in the first thermal transfer fluid as it circulates through the armature 1608. Air may be bubbled through the water and removed from the upper end of the chill tube 1610. Water may be removed from the upper end of the chill tube 1612. The chilling of the water continues while the water is not frozen 1614-NO.

When the water in the interior has formed an ice column 1614-YES, a second thermal transfer fluid having a temperature above the freezing point of water is supplied to the jacket on the chill tube 1616. Turbulence may be induced in the second thermal transfer fluid as it circulates through the jacket on the chill tube 1618. This continues while the ice column remains frozen to the chill tube 1620-NO.

When the outer portion of the ice column has thawed sufficiently to free the ice column from the chill tube 1620-YES, the shutter, if present, is opened 1622. The piston is lifted to elevate a least a portion of the ice column for display 1624. As the ice column is lifted, streams of high pressure water may be selectively discharged inwardly toward a long axis of the chill tube to sculpt the ice column 1626.

When it is desired to end the display of the ice column, the piston is lowered to place the ice column in the interior of the chill tube with water from the pond 1628. Streams of high pressure water may be discharged inwardly toward a long axis of the chill tube to erode the ice column as it is lowered 1630.

The second thermal transfer fluid is supplied to the jacket on the chill tube to melt the ice column 1632. The second thermal transfer fluid may be supplied to the armature to further assist in melting the ice column 1634. In other embodiments, flow of thermal transfer fluid to the armature may be halted during the melting of the ice column. In still other embodiments, flow of the first thermal transfer fluid to the armature may continue during all or a portion of the melting of the ice column so that the ice column remains attached to the armature until melted. The second thermal transfer fluid is supplied to the jacket while the ice column remains unmelted 1636-NO.

Once the ice column has melted, 1636-YES, the method may be repeated to provide a new ice column for display. It will be appreciated that the cylindrical interior of the chill tube may fill with water 1600 during the lowering of the piston 1628 and the subsequent melting of the ice column.

While certain exemplary embodiments have been described and shown in the accompanying drawings, it is to be understood that such embodiments are merely illustrative of and not restrictive on the broad invention, and that this invention is not limited to the specific constructions and arrangements shown and described, since various other modifications may occur to those of ordinary skill in the art. The description is thus to be regarded as illustrative instead of limiting.

What is claimed is:

1. An ice display device comprising:

a chill tube that includes a jacket that receives a first thermal transfer fluid, the chill tube having an interior with a cross-section that extends uniformly from an open upper end to an opposing lower end;

a piston that slides within the chill tube between the upper and lower ends, the piston providing a fluidtight seal against the interior;

a lift coupled to the piston on a side away from the upper end that moves the piston between the upper and lower ends of the chill tube; and a sculpting head coupled to the upper end of the chill tube such that an ice column being lifted by the piston passes through a central opening of the sculpting head, the sculpting head including a plurality of water nozzles arranged to selectively discharge streams of high pressure water from one or more of the plurality of water nozzles into to the central opening of the sculpting head toward a long axis of the chill tube to sculpt an outer surface of the ice column.

2. The ice display device of claim 1, further comprising a plurality of turbulence inducing channels in the jacket of the chill tube, each turbulence inducing channel being formed from a single sheet of material that includes a web supported between two legs that extend from two opposing edges along a length of the web, the legs extending toward the interior of the chill tube, the web including a plurality of deflectors that extend from the web at an angle toward the interior of the chill tube, each deflector having a width of approximately one-half a width of the web and being located adjacent one of the two legs, deflectors adjacent one of the two legs being in a staggered arrangement with deflectors adjacent the other of the two legs.

3. The ice display device of claim 1, further comprising an armature rigidly coupled to the piston such that the armature extends toward the upper end of the cylindrical interior when the piston is at the lower end, the armature having inner passages that receive a second thermal transfer fluid.

4. The ice display device of claim 3, further comprising a plurality of turbulence inducing channels in the armature, each turbulence inducing channel being formed from a single sheet of material that includes a web supported between two legs that extend from two opposing edges along a length of the web, the legs extending toward the exterior of the armature, the web including a plurality of deflectors that extend from the web at an angle toward the exterior of the armature, each deflector having a width of approximately one-half a width of the web and being located adjacent one of the two legs, deflectors adjacent one of the two legs being in a staggered arrangement with deflectors adjacent the other of the two legs.

5. The ice display device of claim 1, wherein the upper end of the cylindrical interior is coupled to a pond below a surface level of water in the pond.

6. The ice display device of claim 1, further comprising a shutter that selectively closes the upper end of the chill tube with a fluidtight seal.

7. A method of creating an ice display, the method comprising:

lowering a piston that seals against a cylindrical interior of a chill tube;

filling the cylindrical interior with water;

supplying a first thermal transfer fluid having a temperature below the freezing point of water to a jacket on the chill tube;

supplying a second thermal transfer fluid having a temperature above the freezing point of water to the jacket on the chill tube when the water in the interior has formed an ice column;

lifting the piston to elevate a least a portion of the ice column for display;

passing the ice column through a central opening of a sculpting head coupled to the upper end of the chill tube as the ice column is elevated; and selectively discharging streams of high pressure water from one or more of a plurality of water nozzles into to the central opening of the sculpting head toward a long axis of the chill tube to sculpt an outer surface of the ice column as it is lifted lowering the piston to place the ice column in the interior of the chill tube with liquid water; discharging streams of high pressure water inwardly toward a long axis of the chill tube to erode the ice column as it is lowered; and supplying the second thermal transfer fluid to the jacket on the chill tube until the ice column completely melts.

8. The method of claim 7, further comprising inducing turbulence in the first and second thermal transfer fluids as they circulate through the jacket on the chill tube.

9. The method of claim 7, further comprising supplying the first thermal transfer fluid to an armature rigidly coupled to the piston and extending toward the upper end when the piston is at an opposing lower end of the cylindrical interior.

10. The method of claim 9, further comprising inducing turbulence in the first thermal transfer fluid as it circulates through the armature.

11. The method of claim 7, further comprising:

closing a fluidtight shutter on the upper end of the chill tube before supplying the first thermal transfer fluid to the jacket on the chill tube; and opening the shutter before lifting the piston.

12. The method of claim 11, further comprising removing water from the upper end of the interior of the chill tube to provide space for forming ice.

13. The method of claim 11, further comprising bubbling air through the water in the interior of the chill tube to promote formation of clear ice and removing the air from the upper end of the interior.

14. The method of claim 7, further comprising:

lowering the piston to place the ice column in the interior of the chill tube with liquid water; and supplying the second thermal transfer fluid to the jacket on the chill tube until the ice column completely melts.

15. The method of claim 14, further comprising discharging streams of high pressure water inwardly toward a long axis of the chill tube to erode the ice column as it is lowered.

16. An ice display device comprising:

means for raising and lowering a piston that seals against a cylindrical interior of a chill tube;

means for filling the cylindrical interior with water;

means for cooling the chill tube to a temperature below the freezing point of water;

means for warming the chill tube to a temperature above the freezing point of water when the water in the interior has formed an ice column;

means for selectively discharging streams of high pressure water from one or more of a plurality of water nozzles into to a central opening above the chill tube toward a long axis of the chill tube to sculpt an outer surface of the ice column as it is lifted through the central opening by the means for raising and lowering the piston means for discharging streams of high pressure water inwardly toward a long axis of the chill tube to erode the ice column as it is lowered; and means for supplying the second thermal transfer fluid to the jacket on the chill tube until the ice column completely melts.

17. The device of claim 16, further comprising means for supporting and cooling an interior of the ice column.

18. The device of claim 16, further comprising means for selectively providing a fluidtight closure on an upper end of the chill tube.

* * * * *